United States Patent [19]

Haga et al.

[11] 4,183,306

[45] Jan. 15, 1980

[54] HOT GAS RECIRCULATION TYPE BURNING FURNACE

[75] Inventors: Toshikatsu Haga; Saburo Hori; Yukio Ito, all of Iwaki, Japan

[73] Assignee: Kureha Kagaku Kogyo Kabushiki Kaisha, Tokyo, Japan

[21] Appl. No.: 839,345

[22] Filed: Oct. 4, 1977

[30] Foreign Application Priority Data

Oct. 8, 1976 [JP] Japan ..... 51/120304

[51] Int. Cl.[2] ..... F23G 7/06

[52] U.S. Cl. ..... 110/204; 110/205; 110/207; 110/212

[58] Field of Search ..... 110/203–214, 110/216, 217, 266, 165 A, 119; 432/72

[56] References Cited

U.S. PATENT DOCUMENTS

| | | | |
|---|---|---|---|
| 1,729,763 | 10/1929 | DeFlorez | 110/205 |
| 1,970,109 | 8/1934 | Stratton | 110/266 |
| 2,917,011 | 12/1959 | Korner | 110/266 |
| 3,364,589 | 1/1968 | Muller | 432/58 |
| 3,452,968 | 7/1969 | Shimizu et al. | 432/58 |
| 3,494,047 | 2/1970 | Geiger et al. | 34/10 |
| 3,567,399 | 3/1971 | Altmann et al. | 110/213 |
| 3,600,817 | 8/1971 | Klein | 34/57 E |
| 3,601,069 | 8/1971 | Mancuso | 110/212 |
| 3,638,591 | 2/1972 | Lansmann | 110/204 |
| 3,740,865 | 6/1973 | Laguilharre | 34/57 E |
| 3,939,781 | 2/1976 | Adams | 110/204 |
| 4,030,876 | 6/1977 | Akae | 432/14 |
| 4,048,927 | 9/1977 | Augustin et al. | 110/217 |

*Primary Examiner*—Henry C. Yuen

*Attorney, Agent, or Firm*—Fleit & Jacobson

[57] ABSTRACT

This invention relates to a burning furnace of hot gas recirculation type for minimizing fuel cost. The furnace includes a cyclone which receives dust-containing exhaust gases. One or more secondary air-introducing nozzles are provided for the cyclone at top of or in close proximity to the upper end of the cyclone leading concentrically to a flue gas passage such as funnel. Upon introducing secondary air under pressure into the cyclone, a downwardly directing swirling air flow is formed therein for the separation of heavier dust together with part of the fed exhaust gases. The thus separated air-hot gas mixture including heavier dust particles is returned to initial stage of the furnace for the recirculation through the furnace. Lighter combustible soot or the like particles are burnt in a flame curtain formed in the cyclone and finally discharged together with main and substantially dust-free exhaust gas portion constituting an upwardly directing swirling core flow in the downwardly directing and swirling outer air flow, into the flue gas passage.

7 Claims, 7 Drawing Figures

HOT GAS RECIRCULATION TYPE BURNING FURNACE

BACKGROUND OF THE INVENTION

This invention relates to a furnace assembly for burning combustible wastes, especially city- and factory wastes.

In almost all conventional furnaces of the above kind, the exhaust hot gases discharged from the exhaust discharge passage, such as funnel, chimney shaft, flue or the like, and yet preserving a large amount of thermal calories, are dissipated in the atmospheric air, so to speak, without recovering the preserved calories.

It is therefore a much desired aim among those skilled in the art to realize an improved burning furnace capable of recovering substantial part of such waste heat and providing an energy-sparing characteristic. Such advantage is highly valuable in consideration of nowaday's high energy cost.

Another national grave problem is the atmospheric pollution which is mainly caused by the discharge of considerable amount of smoke and soot. Various proposals for solving this kind of pollution problem have been proposed and brought into practical use, however, only with partial satisfaction. In fact, these prior proposals have met with other difficulties. In the case of the centrifuge, the collecting effect is relatively small, with respect of soot, on account of very small specific gravity thereof.

In the case of the electric dust collector of the static type, on the other hand, electrical charge will be accumulated in the once collected soot particles which are inclined to have soon the same electrical polarity with the collecting electrode and repulsed and reattracted repeatedly and finally carried away into the atmospheric air, by being accompanied by the discharging exhaust gas streams. When it is intended to reburn the soot, the furnace must have large outline dimensions. Even with such measures, the reburning effect is still smaller than expected. Therefore, these conventional measures are unsuccessful to treat the soot and the like unburnt particles for well preventing atmospheric air pollution.

It is frequently desired in the use of the burning furnace to treat waste brake linings which comprise asbestos fibers molded with a synthetic resin material, or waste grinding wheel blocks which comprise abrasive particles molded again with synthetic resin together, for recovering these valuable fibrous or granular materials, after the removal burning of the contained molding resin. However, it has been experienced that with the conventional burning furnace, a considerable amount of unburnt resin in the form of soot particles is liable to remain as impurities which prevent the desired direct reutilization of the effective recovered material.

SUMMARY OF THE INVENTION

It is, therefore, the main object of the present invention to provide a highly improved burning furnace which provides best measure for minimizing the contained heat energy in the exhaust gases from the furnace with least possible amount of atmosphere-polluting soot or the like fine waste substances.

A further object is to provide the improved furnace of the above kind which is so small and compact as to establish on a highly limited area as in the crowded industrial district.

Still another object of the present invention is to provide the improved burning furnace which is capable of substantially complete combustion of the combustible constituents of the city wastes or the like burning material, so as to provide a chance of reutilization of the residual substances, if desired.

In the furnace of the present invention, one or more combustion chambers is provided, of which the first one is provided with an inlet for introducing the burning material such as, for instance, city wastes. Further, there is provided a cyclone which is connected with an exhaust gas passage leading from the last one of the combustion chamber series and fitted with secondary airintroducing nozzle means positioned preferably at the connection zone or at a slightly lower level, so as to establish downward swirls for the separation of soot and the like fine particle constituents contained in the exhaust gases. Further, there is provided an exhaust gas flute or the like discharging passage connected preferably to the upper part of the cyclone and adapted for discharging the exhaust gases substantially free of soot and the like fine or granular solids, into the open atmosphere. An ejector is provided and has its gas suction inlet positioned at the lower end of the said cyclone. Finally, a hot gas circulation chamber is provided which is connected, on the one hand, with the discharge outlet of the said ejector and, on the other hand, with the combustion chamber series.

BRIEF DESCRIPTION OF THE DRAWINGS

These and further objects, advantages, features and merits of the invention will become more apparent when read in connection with the following detailed description thereof to be set forth with reference to the accompanying drawings in which.

DETAILED DESCRIPTION OF THE INVENTION

Figure 1:
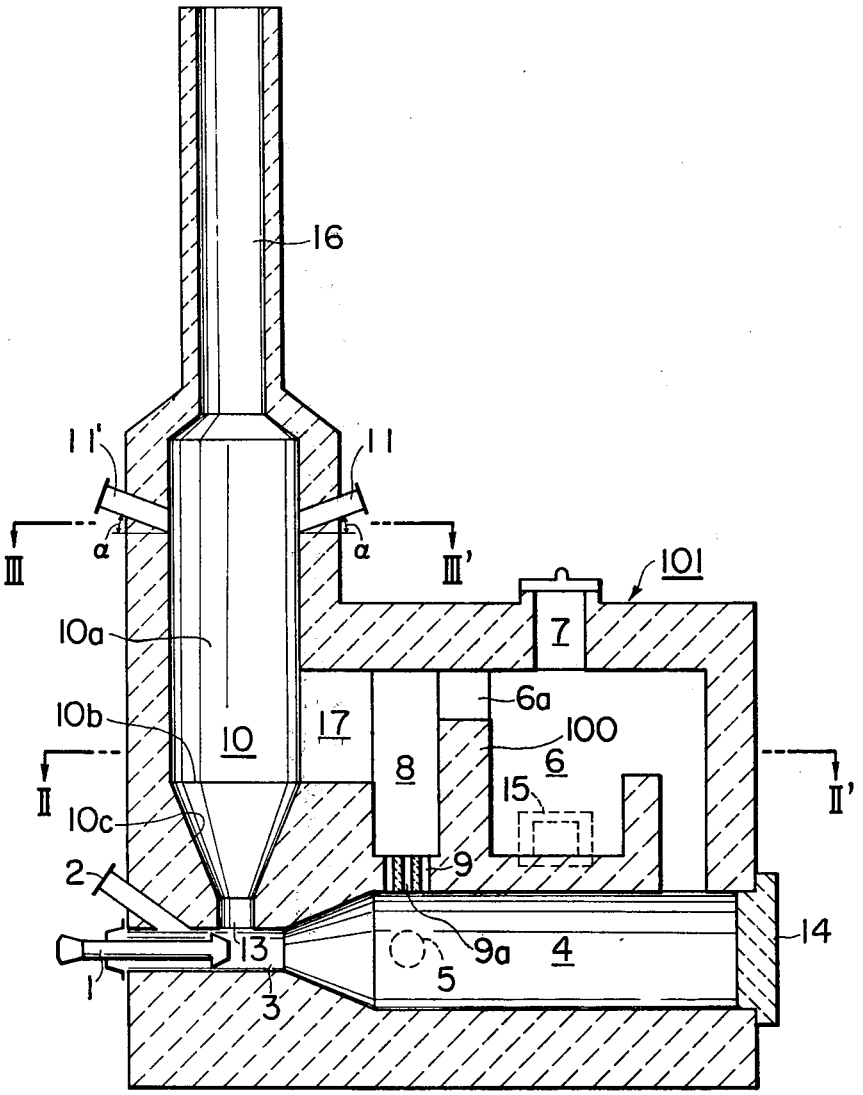
FIG. 1 is a schematic longitudinal section of a preferred embodiment of the burning furnace constructed according to the principle of the invention.

Main structural elements of the furnace comprises an ejector 3; a hot air circulating chamber 4, a burning chamber system comprising a primary chamber 6 and a secondary chamber 8; a cyclone 10 and an exhaust gas flue 16.

The ejector, or more specifically ejector section, may have the known structure of the air ejector, which preferably does not have, however, a throttling means, thus providing a rather simple structure, especially for easy handling and cleaning purposes.

The driving gaseous medium may be a combustible gaseous mixture of propane, natural gas or the like with air, or alternatively, of pulverized or vaporized liquid fuel, preferably kerosene, with air. If, however, the material to burn, such as city wastes, has rather high heat calories and the burning of continuously fed material can continue by utilization of the heat owned by the exhaust gases sucked for recirculation by the suction inlet of the ejector, the addition of combustible gas will be dispensed with, during the whole combustion cycle, with exception of the initial ignition stage. On the other hand, if the initial ignition is carried out in the burning or combustion chamber system, without use of ignition means positioned at the ejector section, the drive gas may be always and exclusively air.

The ejector section 3 is provided with a conventional burner 1 which is arranged coaxially with the section 3 and extends from the inlet end thereof into the interior of the section 3 to a considerable distance, although the burner has been only schematically shown.

The drive gas, preferably a mixture of a combustion gas such as butane with air, is precompressed by a compressor, not shown, to a certain positive pressure, say 0.5 kg/cm$^2$, gauge, and ignited from a closable ignition opening 2, only schematically shown, extending from outside of the furnace assembly, into the initial zone of the ejector section 3 where the burner 1 is positioned.

As an enlarged extension of the section 3, there is provided a hot air circulation chamber 4 which forms a part of the furnace assembly as shown. This chamber 4 is provided with an air inlet 5 which may be provided further with a flow control means such as butterfly valve, although not shown. This inlet may be connected with the said compressor.

At the end portion of this chamber 4, the latter is connected with initial part of a primary burning chamber 6 which constitutes a part of the furnace assembly as shown.

This chamber 6 is provided with a material inlet 7 which is formed through the top wall 101 of the chamber, for introducing the material to be burnt such as city wastes or the like. The chamber 6 has a connecting passage 6*a* which is formed through an intermediate wall 100 provided between the chamber 6 and a next following secondary burning chamber 8 which is constructed also as part of the furnace assembly. The connecting passage 6*a* is provided preferably at the effective top height of these two chambers 6 and 8, as shown.

This secondary burning combustion chamber 8 is fitted with a perforated fire grating 9 having a number of perforations 9*a* connecting physically and fluidically the both chambers 4 and 8.

There is provided a further connecting passage 17 which connects the uppermost part of the chamber 8 with the cyclone 10, preferably at an intermediate level thereof, as shown.

At a relatively higher level of the cyclone 10, the latter is provided with a plurality of, herein shown two as representative, secondary air-introducing nozzles 11 and 11'. At the lowermost end of the cyclone 10, there is provided a gas suction inlet 13 which leads to the ejector section 3 positioned preferably and nearly at the inner end thereof.

Figure 2:
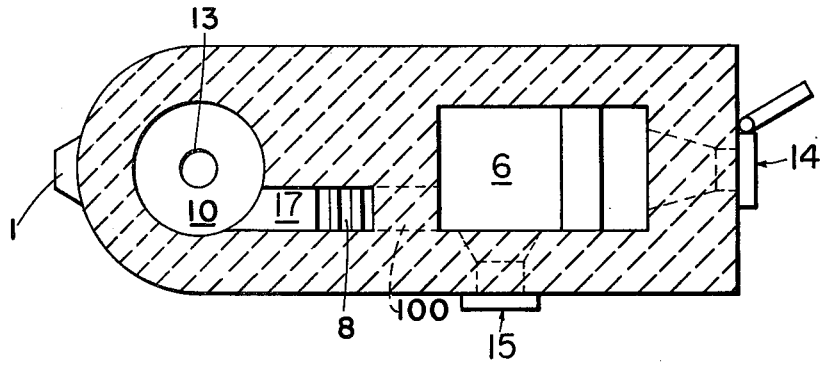
FIG. 2 is a horizontal section of the furnace shown in FIG. 1, taken along the sectional plane II—II' shown therein.

A first dust take-out opening 14 is formed at the right hand end thereof in FIG. 1, said opening being normally closed as shown. A second dust take-out opening 15 is provided for the first combustion chamber 6 formed through the side wall thereof. This opening 15 is provided so as to cover at least the bottom floor level of the chamber 6 and normally closed again, as specifically shown in FIG. 2.

An upperwardly directing flue gas way 16 is provided as shown, the lower end thereof being connected physically and fluidically with the upper end of the cyclone 10, as shown.

The operation of the first embodiment shown and described so far is as follows:

The air-fuel gas mixture is supplied, say at a pressure of 0.5 kg/cm$^2$ through the burner 1 into the ejector section 3 and ignited from the igniter opening 2 which may be fitted with a conventional electrical igniting means utilizing electric sparks when switched on, although not specifically shown. The thus ignited combustible mixture passes horizontally through the section 3 at a high speed and enters into the next following horizontal chamber 4. At this stage, a certain controlled amount of secondary air is introduced through inlet 5 and mixed with the combustion gases in the chamber 4. This hot gaseous mixture is then introduced into the chamber 6 at its initial area. The burnable material such as city wastes is introduced from upper through inlet 7 into this chamber 6 and brought into contact with the hot gas mixture fed thereto and thus burnt, certainly, however, to an incomplete degree. If such is the case, the hot gas mixture containing incompletely burnt combustible gases is conveyed from this chamber 6 through connection passage 6*a* into the next following chamber and mixed with fresh hot gases coming from the chamber 4 through grating 9 and thus having a higher temperature. In this way, the unburnt combustible gaseous components are brought into nearly completely burnt state finally in this or further following combustion chamber or chambers having similar structural features, although not shown.

Figure 3:
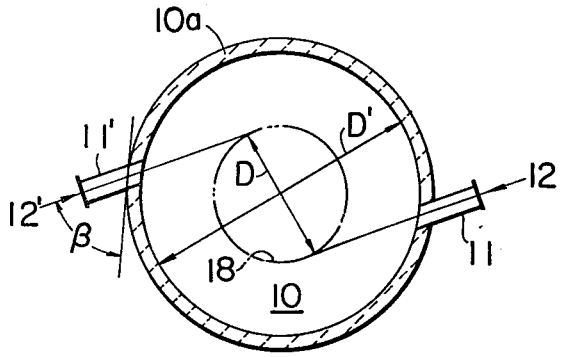
FIG. 3 is a cross-section taken along the sectional plane III—III' shown in FIG. 1.

The thus completely or nearly completely burnt gaseous mixture is then conveyed through connection passage 17 into cyclone 10 and forms therein an upwardly swirling gas flow and mixed at an upper level of the cyclone with a certain amount of secondary air shown only schematically at 12 and 12' in FIG. 3, thus being brought into a practically completely burnt state in the form of an upwardly directing and swirling flame curtain. By the introduction of the secondary air through inlets 11 and 11', a downwardly directing swirling flow is formed concentrically into which unburnt solid particles are carried and finally brought into the section 3 through connection passage 13, and indeed, together with a certain amount of recirculating hot gases, and finally taken out through discharge openings 14 and 15, when they are opened intentionally and preferably at controlled regular time intervals. Under occasion, and if desired, similar dust discharge opening or openings may be provided at the same level or even at a still high level and formed through the surrounding furnace wall at the lower end of cyclone 10 and the passage 13.

In this way, a part of the exhaust gases is recirculated through the burning sections of the furnace assembly and the fuel cost can be substantially reduced. The cost reduction amounts at least to 20–30% according to our practical experiments.

In the present invention, the combustion chamber system comprising primary and secondary chambers 6 and 8, and occasionally still further following combustion chambers, is positioned at a higher level, most preferably directly above the hot gas circulation chamber, thereby providing a superior thermal efficiency.

According to our practical experiments, a considerably high working temperature such as 800°-1,200° C., and under occasion, still higher temperature such as 1,600° C. or so, can easily be attained and thus, a large amount of the material to be burnt can be well treated within a short service period.

The upwardly directing swirling gas flow is discharged finally through flue passage 16 into the open atmosphere. It has been found that the discharging exhaust gases contain only a negligible amount of dust particles, such as 0.1 g/NM$^3$ or less, in comparison with that amounting to 0.3-0.5 g/NM$^3$ as measured at the secondary connection passage 17 and thus in advance of the cyclone 10. However, if a still higher dust separation efficiency should be attained, a secondary cyclone may be provided, say at a position behind the outlet end of the flue passage 16, although not shown. In addition to or in place of this secondary cyclone, an electrical dust collector or the like conventional dust-separating means may be provided under occasion.

Since practically all of the conductive residual carbon dust has already been burnt down in the cyclone 10, the said additional dust collecting service, even if adopted, performs the desired job in a highly easy manner. This advantageous feature will provide such a chance for the utilization of the recovered dust in various ways which means a remarkable progress in the art.

During the high speed passage of the ignited drive gas mixture through ejector portion 3 and thence through a diffuser provided directly thereafter, with a high velocity, hot gas is sucked fluidically through the suction port 13 and into the said portion 3 which communicates with the hot gas recirculation chamber 4. The fluid pressure loss of the drive gas passing through the nozzle 1, amounting to, say, 0.1 kg/cm$^2$ or higher is sufficient, or more advantageous to be 0.3 kg/cm$^2$ or still higher. When the drive gas includes a combustible gas component such as butane, the igniter 2 may be an oil burner of the pneumatic atomizing type, or a conventional gas burner adapted for the igniting purpose as already referred to. In this case, the gaseous mixture delivered from such burner acts as the drive gas for the ejector.

As may be clear from the foregoing description, the hot gas circulation, more correctly recirculation chamber 4 is provided for attaining substantially complete combustion of the combustible gas(es) introduced therein and for mixing secondary air for full combustion of the material to be burnt.

The material to be introduced into the primary one at 6 of the combustion chamber system may be in the form of solids, liquids or a mixture thereof. The introducing inlet 7 may generally be positioned at the ceiling wall 101 of the chamber. But, such positional selection is not limitative.

When the introduced material to be burnt consists substantially of solids, all or any one of the bottom walls of the component chambers of the combustion chamber system may consist of perforated grating, as representatively shown at 9 in FIG. 1, so as to feed high temperature hot gases directly from the recirculation chamber 4 into the related combustion chamber(s). When the material to be burnt contains a considerable amount of liquid, the bottom wall of the primary chamber 6 may be solid, in place of the grating, as shown specifically in FIG. 1. All of the secondary and further following combustion chambers, if any, may have perforated bottom wall.

As the material of such grating, metal, regular refractory or electro-cast refractory may be optionally used, depending upon the kind of the material to be burned.

As was described, the cyclone 10 is fitted with one or more secondary air blow-in inlet or inlets 11 and 11', each of these being mounted at a slightly downwardly inclined position. The inclination angle "alpha" may have a value defined by:

$$0° \leqq \text{alpha} \leqq 30°$$

and more preferably:

$$5° \leqq \text{alpha} \leqq 15°$$

With a larger inclination angle than 30°, the pressure loss of the upwardly directing core-swirling flow may amount to a too much large value which must be discarded for optimal operation of the furnace. The directing angle "beta" of the nozzle 11 or 11' and formed relative to a corresponding tangential line on a horizontal plane will amount to a value defined by:

$$45° \leqq \text{beta} \leqq 85°,$$

more preferably:

$$60° \leqq \text{beta} \leqq 80°$$

or most advantageously, $$70° \leqq \text{beta} \leqq 80°,$$

as schematically represented in FIG. 3. As seen, the inwardly directing direction of the nozzle is offset from the central axis of the cyclone 10.

With blow-in operation of these nozzles 11 and 11' for forced feeding of pressurized secondary air, a downwardly directing swirling air flow is formed within the cyclone and below that level in which these nozzles are mounted through the cylindrical wall **10*a* of the cyclone 10. The central core 18 of this swirling stream is under highly reduced pressure or more correctly substantially evacuated. This central core 18 has a smaller cross-sectional diameter with increased height measured from the lower end 10*b* of the cylindrical main body 10*a* of the cyclone. Thus, at the level of this lower end 10*b*, the core size becomes largest. Since a hot gas stream is fed from the secondary combustion chamber 8 through connection passage 17, it will go up along the evacuated core 18. It is most preferable that the introducing hot gas stream is given a swirling flow in the same direction with that of the downwardly directing outer peripheral air swirls. In this way, soot and the line fine dust still remaining in the thus fed hot gas stream will be easily and centrifugally separated therefrom and mixed into the air swirls when the core stream travels upwardly and centrally of the cyclone 10**. This separating operation is highly accelerated by reason of the gradually and upwardly reducing core diameter dimension which has been referred to hereinbefore. The thus separated fine solid particles will move still outwardly towards the inside wall of the cyclone and carried away downwards with the outer air swirls.

Since soot particles have a relatively small specific gravity value, it is highly difficult to centrifugally transfer from the combustion gas stream to the outer air swirls. However, by the provision of secondary air nozzle or nozzles 11 and 11' under the mounting conditions as set forth hereinbefore, it has been found that a flame curtain is formed precisely or nearly at the inter-surface between the upwardly directing and centrally swirling central core hot gas stream and the outer downwardly directing air swirling flow and the soot particles are subjected to an effective burning in this area. Especially, when the fed secondary air is heated preparatorily, this kind of after-burning of the residual soot can be brought about more easily. However, generally, cold secondary air can be used in place of such previously heated one.

The secondary air introducing-nozzles 11 and 11' may be reduced in number to only one, if occasion may desire. However, in practical purposes, they may be two or even more numerous. If the downwardly directing outer air swirls are so formed as to have a smaller core 18, the cross-sectional area in which downwardly directing flow component is effective to form, is corresponding large and the influencing effect thereof upon the upwardingly directing core hot gas stream is correspondingly large. However, with too much small core diameter as appearing in this way, and by selecting corresponding larger value of "beta", an adverse effect will appear by the mutual interference among the injected secondary air flows through the nozzles 11 and 11', resulting in a poor formation of the outer air swirls. It has been found according to our practical experiments that the ratio of D/D' wherein D' represents the effective diameter of the hollow cylindrical main body 10*a* of the cyclone, while D denotes the diameter of the evacuated core 18, should preferably be 0.1 or larger. With increase of this ratio, the flame curtain effect will be reduced correspondingly. Therefore, the upper limit of the ratio D/D' should be set substantially in consideration of this effect and should be preferably 0.7 at the highest.

Among the values of D, D' and "beta", there is a mathematical relationship as defined by:

$$D = D' \sin(90° - \text{"beta"})$$

When the upper and lower values of D/D' as above set forth are introduced in the above formula, then we will obtain:

$$45° < \text{"beta"} < 85°$$

which was referred to hereinbefore.

However, in practical purposes, preferably $$60° < \text{"beta"} < 80°$$

or still better:

$$70° < \text{"beta"} < 80°$$

as was already referred to.

For swirling the upwardly directing core hot gas stream, there may be several measures. As an example, the hot combustion gases may be introduced from the connection passage 17 in an offset manner into the inside space of the main cylindrical portion 10*a* of cyclone 10 at its lower end 10*b*. This hot gas introduction may preferably be made so as to have upwardly flowing components.

As an alternate measure, although not shown, an introducing guide way can be provided which extends from the passage 17 to open at the central axis or so of the cyclone main body 10*a*, preferably at the level 10*b* or at a still lower level. Stationary swirling means or a rotary fan may be provided precisely at or in close proximity to the outlet of the said hot gas guide means, preferably a duct. A part of the combustion hot gas stream which includes the centrifugally separated fine solids will be separated naturally from the main core stream and conjoin with the downwardly directing outer air swirling stream and then enter into an inverted core space 10*c*, having the sucking opening 13 at its lower end. This stream is sucked through this opening by the sucking zone of the ejector, and so on.

Next, referring to FIGS. 4–7, a modified combustion chamber system or unit will be described in detail.

In these drawings, numeral 21 represents a primary combustion chamber contained in the said unit. Numerals 22, 23, 24 and 25 represent a secondary and three following combustion chambers formed into hollow blocks as shown and connected physically and fluidically one after another by means of connecting passages 26, 27, 28 and 29, respectively. The fifth or last combustion chamber 25 is connected through a cyclone to a flue 30. Although only schematically shown, the cyclone-flue combination can preferably be made in the foregoing manner shown and described in the first embodiment.

All the combustion chambers 21–25 have a common bottom wall panel 31 made as a part of the furnace unit 37 and having perforations 32, 32' and 32'' for establishing fluid communication between a horizontally extending hot gas recirculation chamber 33 with each of these combustion chambers 21–25. The chamber 33 may have similar structure and function with that shown at 4 in the first embodiment, although not specifically shown. The structural and operational connection mode between the recirculation chamber 33 and an ejector section, not shown, may be substantially same with the first embodiment, although not specifically shown.

Numeral 34 denotes a material-introducing inlet to the main combustion 21, said inlet being closable again and provided at a level slightly above the grating panel 31. Although this panel is in FIG. 5 as planar, it may preferably have a convex style as most clearly shown in FIG. 6. This feature is also applicable to a still further embodiment shown in FIG. 7.

Figure 6:
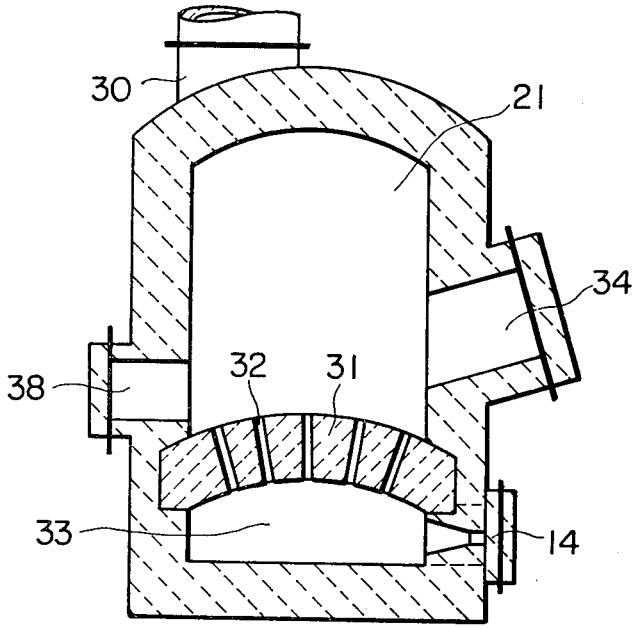
FIG. 6 is a cross-section taken substantially along the section line VI—VI' in FIG. 4.

Through the opposite side wall of the main combustion chamber 21 when seen in FIG. 6, a closable dust discharge opening 38 is provided, as in the same manner at 15 in the first embodiment. Numeral 14 represents a similar closable dust discharge opening, as provided in the first embodiment.

This modified arrangement is highly compact, in spite of an increased number of secondary to fifth combustion chambers for attaining nearly complete combustion. The operational mode of this modified furnace assembly will be well understood from the foregoing structural disclosure, when consultation is made with the functional disclosure of the first embodiment. Not shown other structure may be made similar thereto.

Figure 4:
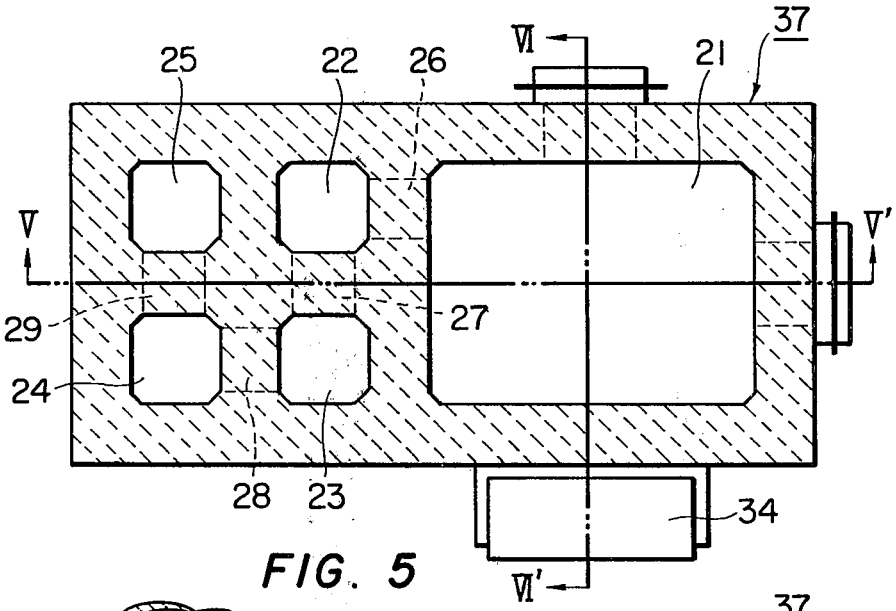
FIG. 4 is a horizontal section of a slightly modified embodiment of main portion of the furnace assembly, comprising a hot gas recirculation chamber, a main combustion chamber and four successive subsidiary combustion chambers, taken substantially along a section line IV IV in FIG. 5.
Figure 5:
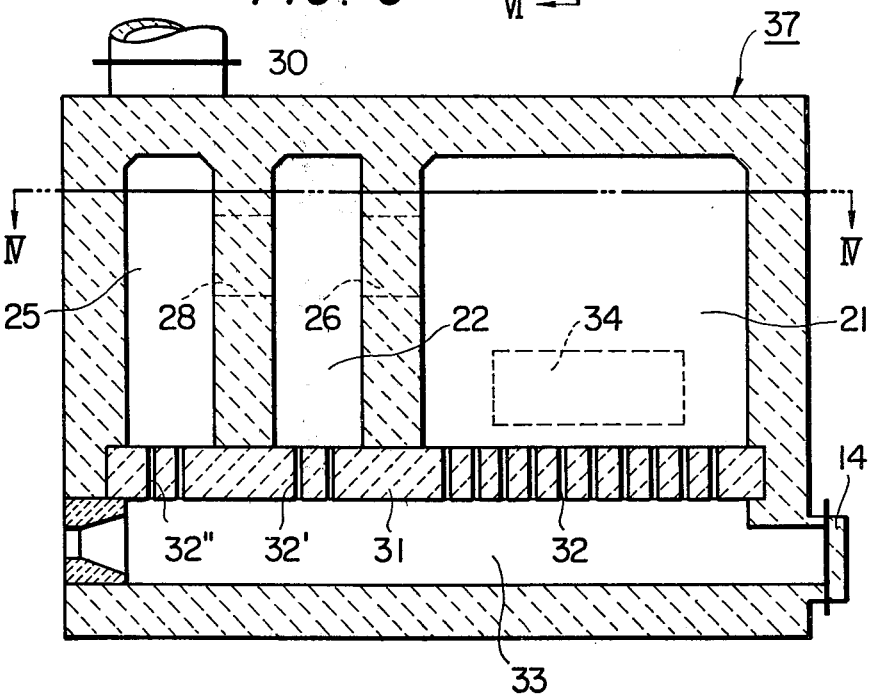
FIG. 5 is a vertical section of the same main portion taken substantially along the section line V—V' in FIG. 4.
Figure 7:
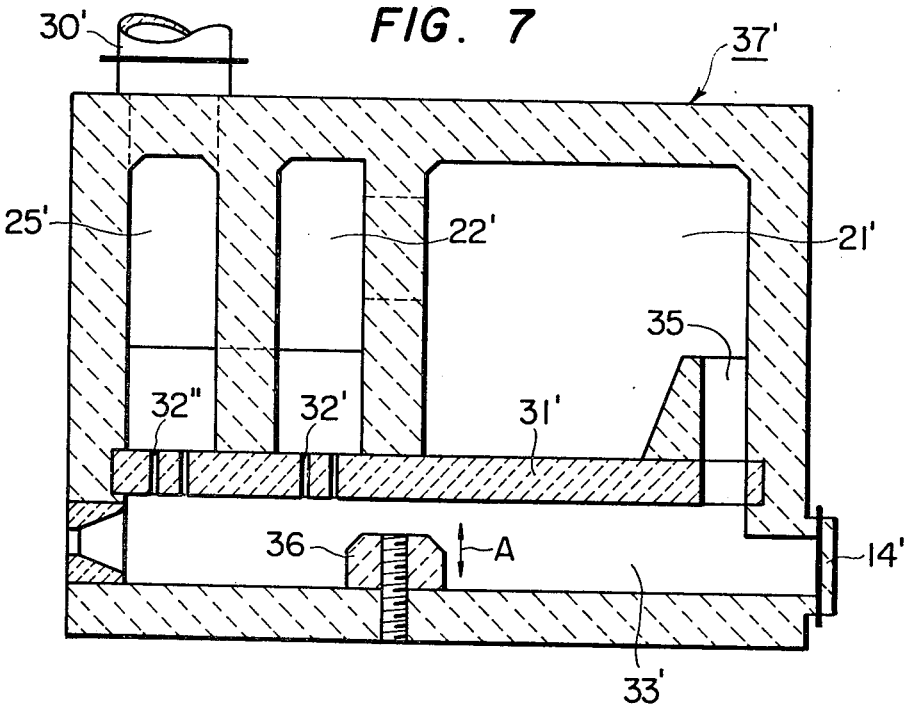
FIG. 7 is a similar view to FIG. 5, showing a still further modified arrangement.

A still further modified embodiment is shown in FIG. 7. In this modification, reference numerals denoting similar parts as those employed in the foregoing modification shown in FIGS. 4–6 are represented with same respective numerals, however, attached each with a prime.

The bottom wall panel 31' is not perforated within the area covering the main combustion chamber 21' for easy burning of the introduced material of liquid or tarry form or at least including a considerable amount of combustible liquid component. This feature has been embodied also in the foregoing first embodiment shown in FIGS. 1–3. In the present modification, hot gases are conveyed from the recirculation chamber 33' into the main combustion chamber 21' through a connecting duct provided at or in close proximity to the downstream end of the chamber 33' and specifically denoted with the numeral 35. This feature has also been embodied in the said first embodiment.

At an intermediate position when seen in the longitudinal direction of the chamber 33', there is provided an adjustable barrier 36 which can be lowered or elevated from outside of the furnace assembly 37' as hinted by a double head arrow "A", by manipulating a handwheel or the like means and conventional motion connecting means such as chain, screw and the like, although not specifically shown. By adjusting the effective height of this barrier 36, the distribution of hot gases among the main and the following subsidiary combustion chambers 21'–25' through duct 35 and gratings 32'; 32'' may be modified so as to meet occasional demand.

The embodiments of the invention in which an exclusive property or privilege is claimed are as follows:

1. A burning furnace comprising a cyclone for receiving exhaust gases, one or more secondary air-introducing nozzles attached to said cyclone at a top portion thereof or in close proximity to said top portion for forming a downwardly directing swirling air flow within the interior of said cyclone, said exhaust gases being introduced into an evacuated core of said swirling air flow for centrifugal separation of heavier dust particles from said exhaust gases, a portion of said exhaust gases being separated from the other exhaust gases and being mixed with the secondary air, the mixture of said secondary air with said separated exhaust gas portion being returned to a beginning portion of the furnace for recirculation, an ejector having a suction inlet provided at the lower end of said cyclone, a hot gas recirculation chamber having an inlet connected with an outlet of said ejector, and a combustion chamber system connected fluidically with the downstream end of said recirculation chamber, said hot gas recirculation chamber being separated by a wall from said combustion chamber system and being positioned at a slightly lower level than said combustion chamber system.

2. The furnace of claim 1 wherein said cyclone has a circular cross-section and wherein each of said one or more nozzles has an inclined angle of 45–85 degrees relative to a line drawn tangential to the circular cross-section of said cyclone, when seen on a horizontal plane.

3. The furnace of claim 2, wherein each of said one or more nozzles has a downwardly inclining angle of 0–30 degrees relative to a horizontal plane.

4. The furnace of claim 1 wherein said hot gas recirculation chamber is positioned directly below said combustion chamber system.

5. The furnace of claim 1 wherein said exhaust gases are introduced into a lower portion of said cyclone.

6. A burning furnace comprising a cyclone for receiving exhaust gases, one or more secondary air-introducing nozzles attached to said cyclone at a top portion thereof or in close proximity to said top portion for forming a downwardly directing swirling air flow within the interior of said cyclone, said exhaust gases being introduced into an evacuated core of said swirling air flow for centrifugal separation of heavier dust particles from said exhaust gases, a portion of said exhaust gases being separated from the other exhaust gases and being mixed with the secondary air, the mixture of said secondary air with said separated exhaust gas portion being returned to a beginning portion of the furnace for recirculation, a hot gas recirculation chamber having an inlet communicating with a bottom portion of said cyclone, and a combustion chamber system having a plurality of component chambers with bottom walls arranged at the same level, at least one of said bottom walls having an opening formed therein establishing communication between said combustion chamber system and said hot gas recirculation chamber for distributing hot gases between said recirculation chamber and said component combustion chamber.

7. A burning furnace comprising a cyclone for receiving exhaust gases, one or more secondary air-introducing nozzles attached to said cyclone at a top portion thereof or in close proximity to said top portion for forming a downwardly directing swirling air flow within the interior of said cyclone, said exhaust gases being introduced into an evacuated core of said swirling air flow for centrifugal separation of heavier dust particles from said exhaust gases, a portion of said exhaust gases being separated from the other exhaust gases and being mixed with the secondary air, the mixture of said secondary air with said separated exhaust gas portion being returned to a beginning portion of the furnace for recirculation, an ejector having a suction inlet provided at the lower end of said cyclone, a hot gas recirculation chamber having an inlet connected with an outlet of said ejector, and a combustion chamber system connected fluidically with the downstream end of said recirculation chamber, the combustion chamber system having component chambers with bottom walls arranged at the same level, at least one of said bottom walls being perforated to form a grating communicating with said recircualation chamber for distributing the hot gases therefrom among the component combustion chambers of said system.

* * * * *